US009446440B2

(12) United States Patent
Engesser

(10) Patent No.: US 9,446,440 B2
(45) Date of Patent: Sep. 20, 2016

(54) METHOD FOR PRODUCING A GUN BARREL HAVING BARREL FLUTINGS

(71) Applicant: Steyr Mannlicher GmbH, Kleinraming (AT)

(72) Inventor: Michael Engesser, Sulzbach (AT)

(73) Assignee: Steyr Mannlicher GmbH, Kleinraming (AT)

( * ) Notice: Subject to any disclaimer, the term of this patent is extended or adjusted under 35 U.S.C. 154(b) by 0 days.

(21) Appl. No.: 14/772,465

(22) PCT Filed: Jan. 15, 2014

(86) PCT No.: PCT/AT2014/050011
§ 371 (c)(1),
(2) Date: Sep. 3, 2015

(87) PCT Pub. No.: WO2014/134645
PCT Pub. Date: Sep. 12, 2014

(65) Prior Publication Data

US 2016/0016217 A1 Jan. 21, 2016

(30) Foreign Application Priority Data

Mar. 7, 2013 (AT) ..... A 50157/2013

(51) Int. Cl.
*B21C 37/15* (2006.01)
*F41A 21/24* (2006.01)
(Continued)

(52) U.S. Cl.
CPC ..... *B21C 37/152* (2013.01); *B21J 7/14* (2013.01); *B21K 1/066* (2013.01); *F41A 21/24* (2013.01)

(58) Field of Classification Search
CPC ..... B21C 37/152; B21C 37/153; B21J 7/14; B21J 7/145; B21J 7/16; B21K 1/063; B21K 1/066; F41A 21/24
USPC ..... 42/76.1
See application file for complete search history.

(56) References Cited

U.S. PATENT DOCUMENTS 2,104,319 A * 1/1938 Dicke ..... B21C 37/153 42/76.01
3,228,298 A * 1/1966 Grandy ..... F41A 21/02 42/76.02
3,738,044 A * 6/1973 Robinson ..... F41A 21/00 42/75.02

(Continued)

FOREIGN PATENT DOCUMENTS

DE 16299 3/1881
DE 3120230 9/1982

(Continued)

OTHER PUBLICATIONS

International Preliminary Report on Patentability for International Application No. PCT/AT2014/050011.

(Continued)

*Primary Examiner* — Bret Hayes
(74) *Attorney, Agent, or Firm* — Hoffmann & Baron, LLP

(57) ABSTRACT

The invention relates to a method for producing a gun barrel by cold forging a cylindrical blank in a barrel hammering machine, which has a plurality of forging hammers distributed around the circumference of the blank and acting radially on the blank, wherein forging hammers having ribs parallel to the longitudinal axis of the blank are used in order to forge longitudinal grooves in the blank during the cold forging.

3 Claims, 1 Drawing Sheet

(51) Int. Cl.
*B21J 7/14* (2006.01)
*B21K 1/06* (2006.01)

(56) References Cited

U.S. PATENT DOCUMENTS 4,043,173 A * 8/1977 Marciniak ..... B21J 5/12 72/402
4,722,216 A * 2/1988 Fencl ..... B21C 37/16 72/370.04
5,894,753 A 4/1999 Sachot et al.
6,324,780 B1 * 12/2001 Behling ..... F41A 21/18 42/78
7,950,153 B2 * 5/2011 Dohmann ..... B21J 5/12 29/893.34
8,025,003 B1 * 9/2011 Saur ..... F41A 21/24 42/76.01
8,117,884 B2 * 2/2012 Deriaz ..... B21D 53/28 72/370.16
2002/0017123 A1 * 2/2002 Wieser ..... B21J 5/00 72/402
2010/0307045 A1 * 12/2010 Taylor ..... F41A 21/18 42/76.1
2012/0110885 A1 * 5/2012 Pelin ..... B21H 1/18 42/75.02

FOREIGN PATENT DOCUMENTS

FR 2755042 10/1996
GB 631438 11/1949
WO WO 2009/056848 5/2009

OTHER PUBLICATIONS

Austrian Office Action for 1A A 50157/2013 dated Feb. 24, 2014.
International Preliminary Report on Patentability (IPRP) (in German) for PCT/AT2014/050011 dated Jun. 25, 2015.

* cited by examiner

METHOD FOR PRODUCING A GUN BARREL HAVING BARREL FLUTINGS

CROSS-REFERENCE TO RELATED APPLICATIONS

This application is a National Phase application of International Application No. PCT/AT2014/050011 filed Jan. 15, 2014 which claims priority to Austrian Patent Application No. A 50157/2013 filed Mar. 7, 2013, the disclosures of which are incorporated herein by reference.

The present invention relates to a method for producing a gun barrel having barrel flutings.

BACKGROUND

In order to reduce the weight of a (hunting) rifle, the gun barrel is often provided with so-called barrel flutings, which are grooves distributed around the circumference of the gun barrel and extending in the longitudinal direction of the gun barrel (see, e.g., DE 16299 C). As a result, despite the weight reduction, the desired rigidity and the minimum wall thickness of the gun barrel are achieved without negatively influencing the vibration behavior of the gun barrel when the shot is fired.

Such barrel flutings are currently milled in a material-removing manner in succession, individually or, at best, in pairs. The disadvantages thereof are the great amount of production work involved and the different surface roughnesses, which can also result in greater adhesion of contaminants.

According to DE 16299 C, the barrel flutings can be produced by means of a separate forging step rather than a separate milling step, although this also requires a great amount of work. According to FR 2 755 042 A1, it is known per se from the field of vehicle engineering to create longitudinal grooves or ribs in steering axles by means of forging hammers.

SUMMARY

The objective of the invention is to create a method for producing a gun barrel having barrel flutings, which overcomes the disadvantages of the prior art.

This objective is achieved with a method for producing a gun barrel by cold forging a cylindrical blank having an axial passage opening, comprising the steps: introducing a forging mandrel into the axial passage opening of the cylindrical blank; cold forging the gun barrel by means of a gun barrel forging machine, which has a plurality of forging hammers, which are distributed around the circumference of the blank and act radially onto the blank in the region of the inserted forging mandrel; and, during the cold forging, forging longitudinal grooves into the blank by means of said forging hammers, which have ribs that are parallel to the longitudinal axis of the blank for this purpose.

By means of the concurrent forging of the barrel flutings or grooves, respectively, directly during the cold forging ("hammering") of the gun barrel in the gun barrel forging machine, there is no disadvantageous material-removing forging processing of the gun barrel, which significantly simplifies production. In addition to reducing the production costs, other benefits are a uniform surface, a low surface roughness, and a homogeneous rigidity of the entire fluted gun barrel across the material cross-section, in particular also in the region of the barrel flutings.

Preferably, four forging hammers are used, each of which has one to four ribs, which ribs are distributed regularly around the circumference of the blank in order to achieve a good compromise between weight savings and rigidity, depending on the caliber.

BRIEF DESCRIPTION OF THE DRAWINGS

The invention is explained in the following in greater detail with reference to an embodiment illustrated in the attached drawings. In the drawings.

DETAILED DESCRIPTION

Figure 1:
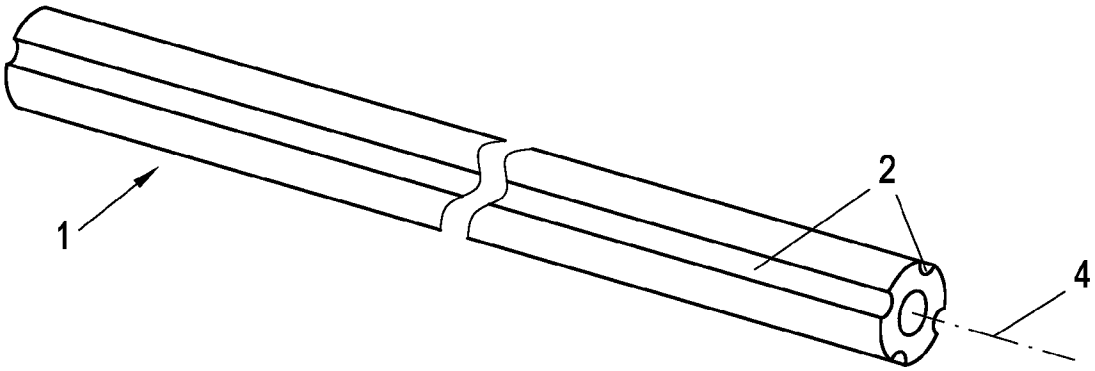
FIG. 1 shows a perspective view of a gun barrel provided with barrel flutings.

FIG. 1 shows a gun barrel 1 for a rifle or any other type of firearm (not shown). The gun barrel 1 is provided with a plurality of longitudinal grooves (barrel flutings) 2, which are distributed around the circumference thereof and make it possible to reduce the weight while maintaining the desired rigidity, minimum wall thickness, and vibration behavior of the gun barrel, as is known to a person skilled in the art.

Figure 2:
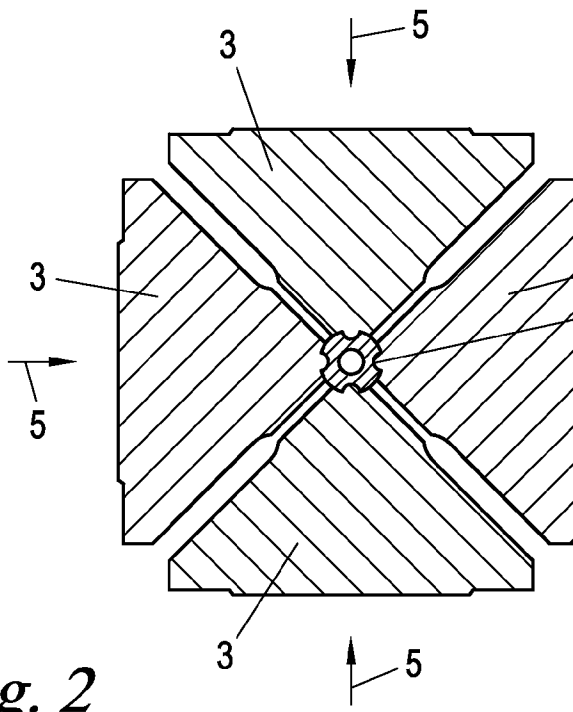
FIGS. 2 and 3 show various embodiments of forging hammers of a gun barrel forging machine, in an axially normal cut, for carrying out the method of the invention.
Figure 3:
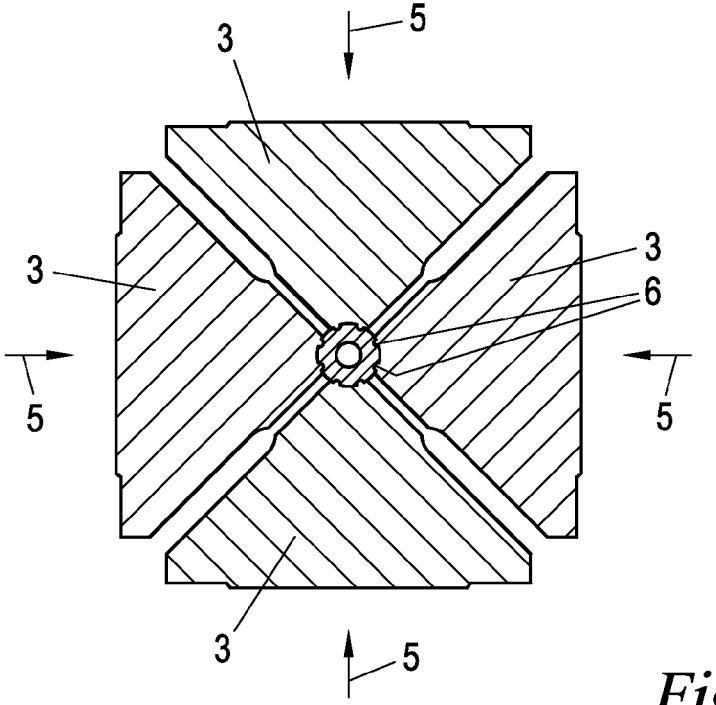

The longitudinal grooves 2 of the gun barrel 1 are produced directly during the cold forging (hammering) of the gun barrel 1 in a gun barrel forging machine, of which only the forging hammers 3 are shown, in a cut normal to the axial direction 4 of the gun barrel 1, in FIGS. 2 and 3. In the example shown, four forging hammers 3 are used, which are distributed around the circumference of the gun barrel 1 and act or hammer radially in the direction of the arrows 5 on the gun barrel 1 accommodated therebetween.

The cold forging starts with a cylindrical blank having an axial passage opening, into which a forging or hammering mandrel (not shown) is inserted, whereupon the forging hammers 3 hammer onto the blank in the region of the inserted hammering mandrel in order to forge it such that it becomes the gun barrel. The axial length of the forging hammers 3 is usually shorter than the length of the gun barrel 1, such that the forging hammers 3 and the hammering mandrel therein, which functions as a support, are moved in the axial direction relative to the gun barrel 1. In practical application, the gun barrel 1 is moved in the axial direction 4 through the forging hammers 3 of the gun barrel forging machine, while the hammering mandrel is held in the gun barrel, in the region of the forging hammers 3, on a holding device, e.g., a holding rod.

For the present invention, the forging hammers 3 are equipped, on the hammering surfaces thereof acting on the blank or the gun barrel, with ribs 6, which are parallel to the longitudinal axis 4 of the blank or the gun barrel. In the embodiment shown in FIG. 2, one longitudinal rib 6 is used per forging hammer 3, and in the embodiment shown in FIG. 3, two longitudinal ribs 6 are used per forging hammer 3. The ribs 6 of all forging hammers 3 are distributed substantially regularly around the circumference of the blank or the gun barrel 1.

By means of the ribs 6, the barrel flutings or longitudinal grooves 2, respectively, are forged directly into the gun barrel 1 during the cold forging of the blank to form the gun barrel 1.

The invention is not limited to the illustrated embodiments and, instead, comprises all variants and modifications that fall within the scope of the appended claims.

What is claimed is:

1. A method for producing a gun barrel by cold forging a cylindrical blank having an axial bore therethrough, comprising the steps:

introducing a forging mandrel into the axial bore of the cylindrical blank;

cold forging the gun barrel with a gun barrel forging machine, the machine including a plurality of forging hammers distributed around the circumference of the blank, the hammers acting radially on the blank where the mandrel has been introduced; and, during the cold forging, forging a plurality of longitudinal grooves into the blank via at least one rib on each hammer, the at least one rib extending parallel to a longitudinal axis of the blank.

2. The method according to claim 1, wherein the plurality of hammers comprises four forging hammers and wherein each hammer includes from one to four ribs.

3. The method according to claim 1, wherein the longitudinal grooves are evenly distributed around the circumference of the blank.

* * * * *